US007476479B2

(12) United States Patent
Tong et al.

(10) Patent No.: US 7,476,479 B2
(45) Date of Patent: Jan. 13, 2009

(54) HYDROLYZED SEMI-CONDUCTIVE NANOPARTICLES FOR IMAGING MEMBER UNDERCOATING LAYERS

(75) Inventors: Yuhua Tong, Webster, NY (US); John J. Wilbert, Macedon, NY (US); John F. Yanus, Webster, NY (US); Jin Wu, Webster, NY (US); Jennifer Y. Hwang, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 584 days.

(21) Appl. No.: 11/073,549

(22) Filed: Mar. 8, 2005

(65) Prior Publication Data

US 2006/0204872 A1 Sep. 14, 2006

(51) Int. Cl.
*G03G 5/14* (2006.01)

(52) U.S. Cl. ..... 430/60; 430/64; 430/65; 430/131

(58) Field of Classification Search ..... 430/60, 430/64, 65, 131
See application file for complete search history.

(56) References Cited

U.S. PATENT DOCUMENTS

| | | | | |
|---|---|---|---|---|
| 3,121,006 | A | | 2/1964 | Middleton et al. |
| 3,357,989 | A | | 12/1967 | Byrne et al. |
| 3,442,781 | A | | 5/1969 | Winberger |
| 4,081,274 | A | | 3/1978 | Horgan |
| 4,115,116 | A | | 9/1978 | Stolka et al. |
| 4,233,384 | A | | 11/1980 | Turner et al. |
| 4,265,990 | A | | 5/1981 | Stolka et al. |
| 4,299,897 | A | | 11/1981 | Stolka et al. |
| 4,304,829 | A | | 12/1981 | Limburg et al. |
| 4,306,008 | A | | 12/1981 | Pai et al. |
| 4,415,639 | A | | 11/1983 | Horgan |
| 4,647,521 | A | | 3/1987 | Oguchi et al. |
| 4,664,995 | A | | 5/1987 | Horgan et al. |
| 4,675,262 | A | | 6/1987 | Tanaka |
| 4,678,731 | A | | 7/1987 | Yoshizawa et al. |
| 4,713,308 | A | | 12/1987 | Yoshizawa et al. |
| 4,717,637 | A | | 1/1988 | Yoshizawa et al. |
| 4,784,928 | A | | 11/1988 | Kan et al. |
| 4,869,982 | A | | 9/1989 | Murphy |
| 5,008,167 | A | | 4/1991 | Yu |
| 5,096,795 | A | | 3/1992 | Yu |
| 5,521,047 | A | | 5/1996 | Yuh et al. |
| 5,707,767 | A | | 1/1998 | Yu |
| 5,709,974 | A | | 1/1998 | Yuh et al. |
| 5,737,669 | A | * | 4/1998 | Ring ..... 399/130 |
| 5,789,127 | A | | 8/1998 | Yamaguchi et al. |
| 5,891,594 | A | | 4/1999 | Yuh et al. |
| 5,958,638 | A | | 9/1999 | Katayama et al. |
| 6,074,791 | A | * | 6/2000 | Jennings et al. ..... 430/58.8 |
| 6,214,514 | B1 | | 4/2001 | Evans et al. |
| 6,261,729 | B1 | | 7/2001 | Yuh et al. |
| 6,277,535 | B1 | | 8/2001 | Liu et al. |
| 7,018,758 | B2 | * | 3/2006 | Tong et al. ..... 430/64 |

OTHER PUBLICATIONS

USPTO Trademark Electronic Search System (TESS) printout describing US trademark JEFFAMINE. registration date Oct. 13, 1970.*

Diamond, A. S., ed., *Handbook of Imaging Materials*, Marcel Dekker, Inc., NY (1991), pp. 395-396.*

Grant, R., et al., ed., *Grant & Hackh's Chemical Dictionary*, fifth edition, McGraw-Hill Book Company, NY (1987), pp. 224 and 461.*

* cited by examiner

*Primary Examiner*—Janis L Dote
(74) *Attorney, Agent, or Firm*—Oliff & Berridge, PLC

(57) ABSTRACT

An imaging member includes a substrate, an intermediate layer, and a photoconductor layer, where the intermediate layer includes hydrolyzed semi-conductive nanoparticles, such as hydrolyzed semi-conductive nanoparticles formed by reaction of a metal alkoxide and an amine.

15 Claims, No Drawings

HYDROLYZED SEMI-CONDUCTIVE NANOPARTICLES FOR IMAGING MEMBER UNDERCOATING LAYERS

BACKGROUND

The present disclosure relates to improved photoreceptor designs for electrostatographic printing devices, particularly photoreceptors having hydrolyzed semi-conductive nanoparticles incorporated into an undercoating layer. More particularly, the present disclosure relates to photoreceptors having an undercoating layer that includes hydrolyzed semi-conductive nanoparticles of metal alkoxide and an amine.

In electrophotography, an electrophotographic substrate containing a photoconductive insulating layer on a conductive layer is imaged by first uniformly electrostatically charging a surface of the substrate. The substrate is then exposed to a pattern of activating electromagnetic radiation, such as, for example, light. The light or other electromagnetic radiation selectively dissipates the charge in illuminated areas of the photoconductive insulating layer while leaving behind an electrostatic latent image in non-illuminated areas of the photoconductive insulating layer. This electrostatic latent image is then developed to form a visible image by depositing finely divided electroscopic marking particles on the surface of the photoconductive insulating layer. The resulting visible image is then transferred from the electrophotographic substrate to a necessary member, such as, for example, an intermediate transfer member or a print substrate, such as paper. This image developing process can be repeated as many times as necessary with reusable photoconductive insulating layers.

Electrophotographic imaging members (i.e. photoreceptors) are well known. Electrophotographic imaging members are commonly used in electrophotographic (xerographic) processes having either a flexible belt or a rigid drum configuration. These electrophotographic imaging members sometimes comprise a photoconductive layer including a single layer or composite layers. These electrophotographic imaging members take many different forms. For example, layered photoresponsive imaging members are known in the art. U.S. Pat. No. 4,265,990 describes a layered photoreceptor having separate charge generating and charge transport layers. The charge generating layer disclosed in the 990 patent is capable of charge generating holes and injecting the photogenerated holes into the charge transport layer. Thus, in the photoreceptors of the 990 patent, the charge generating material generates electrons and holes when subjected to light.

More advanced photoconductive photoreceptors containing highly specialized component layers are also known. For example, a multilayered photoreceptor employed in electrophotographic imaging systems sometimes includes one or more of a substrate, an undercoating layer, an intermediate layer, an optional hole or charge blocking layer, a charge generating layer (including a charge generating material in a binder) over an undercoating layer and/or a blocking layer, and a charge transport layer (including a charge transport material in a binder). Additional layers such as one or more overcoating layer or layers are also sometimes included.

U.S. Pat. No. 5,958,638 discloses some known materials used for undercoating layers. Materials known to be usable in intermediate and undercoating layers include a resin material alone, such as polyethylene, polypropylene, polystyrene, acrylic resin, vinyl chloride resin, vinyl acetate resin, polyurethane, epoxy resin, polyester, melamine resin, silicone resin, polyvinyl butyryl, polyamide and copolymers containing two or more of repeated units of these resins. Such resin materials also include casein, gelatin, polyvinyl alcohol, ethyl cellulose, etc. Intermediate and undercoating layers are typically formed by a proper coating technique, like dip coating process, such as the methods disclosed in, for example, U.S. Pat. Nos. 5,958,638 and 5,891,594.

U.S. Pat. No. 6,277,535 discloses alternative materials used for undercoating layers. The patent discloses that the undercoating layer can include materials derived from the reaction of a silyl-functionalyzed polymer with a first silane coupling agent and an optional second silane coupling agent. The material is described to provide a mechanically and electrically robust undercoating layer.

U.S. Pat. No. 5,789,127 discloses an electrophotographic photoreceptor comprising an electrically-conductive substrate having provided thereon an undercoat layer and a photoconductive layer. The undercoat layer is formed by using a high molecular weight compound having an alkoxysilyl group; a high molecular weight compound having an alkoxysilyl group and an organic metal compound; or a high molecular weight compound having an alkoxysilyl group, an organic metal compound and a silane coupling agent. As the organic metal compound there may be preferably used at least one selected from the group consisting of an organic zirconium compound and an organic titanium compound.

U.S. Pat. No. 6,261,729 discloses a photoreceptor including: a substrate, a charge blocking layer including n-type particles and a linear phenolic binder composition, and an imaging layer. The n-type particles of the blocking layer can be, for example, metal oxide particles such as needle shaped titanium dioxide particles or grain shaped titanium dioxide particles.

SUMMARY

Such known photoconductors are susceptible to charge injection from the substrate into the photosensitive layer such that the charge on the surface of the photoconductor may be microscopically dissipated or decayed. This often results in production of a defective image. Various exemplary embodiments of a photoreceptor according to this disclosure interpose an intermediate or undercoating layer between a substrate and a photosensitive layer to improve chargeability of the photoconductor, and to enhance adhering and coating properties of the photosensitive layer with respect to the substrate.

The above-mentioned treatment techniques are deficient in several ways. Defects in subsystems of a xerographic, electrophotographic or similar image forming system, such as a laser printer, digital copier or the like, may give rise to visible streaks or defects in a printed image. Such defects often arise from a non-uniform LED imager, contamination of high voltage elements in a charger, scratches in the photoreceptor surface, or other causes. For example, the intermediate and undercoating layer used in certain conventional devices is derived from needle-shaped titanium dioxide nanoparticles dispersed in thermally cross-linkable phenolic resin. This sometimes results in one or more of the previously mentioned defects.

This disclosure provides an intermediate and/or undercoating layer for photoreceptors.

This disclosure separably provides an intermediate and/or undercoating layer including hydrolyzed semi-conductive nanoparticles.

This disclsoure separably provides a photoconductive imaging member having a substrate, an intermediate and/or undercoating layer including a polymer resin and hydrolyzed semi-conductive nanoparticles, and a photosensitive component.

In particular, the present disclosure provides an imaging member comprising:

a substrate;

an intermediate layer; and a photoconductor layer;

wherein the intermediate layer comprises hydrolyzed semi-conductive nanoparticles.

The present disclosure also provides a method for making such an imaging member, generally comprising:

providing an imaging member substrate, and applying an intermediate layer over said substrate, and applying at least a charge generating layer and a charge transport layer over said intermediate layer, and wherein said intermediate layer comprises hydrolyzed semi-conductive nanoparticles.

DETAILED DESCRIPTION OF PREFERRED EMBODIMENTS

In various exemplary embodiments of an electrophotographic imaging member in accordance with this disclosure, an imaging member includes a substrate; at least one of an intermediate and/or undercoating layer formed on the substrate; at least one optional additional layer that may be located on or under the at least one of an intermediate and/or undercoating layer, and a photoconductor or photosensitive layer formed on the at least one of an intermediate and/or undercoating layer. In various exemplary embodiments, a photoconductor layer includes a charge generating layer and a charge transport layer. Various exemplary embodiments include other layers, such as an adhesive layer.

In various exemplary embodiments of this disclosure, an intermediate and/or undercoating layer is located between a substrate and a photoconductor or photosensitive layer. In various exemplary embodiments, additional layers are present and are located between a substrate layer and a photoconductive or photosensitive layer.

In various exemplary embodiments of the disclosure, an intermediate and/or undercoating layer includes hydrolyzed semi-conductive nanoparticles. Such hydrolyzed semi-conductive nanoparticles can be dispersed in an appropriate resin, if desired. Intermediate and/or undercoating layers are typically formed by a dip coating process, such as the methods disclosed in, for example, U.S. Pat. Nos. 5,958,638 and 5,891,594.

According to embodiments of the present disclosure, an electrophotographic imaging member is provided, which generally comprises at least a substrate layer, an intermediate and/or undercoating layer, a charge generating layer, a charge transport layer, and an optional overcoating layer. The charge generating layer and the charge transport layer can, in embodiments, be combined in a single layer. This imaging member can be employed in an imaging process comprising providing the electrophotographic imaging member, depositing a uniform electrostatic charge on the imaging member with a corona charging device, exposing the imaging member to activating radiation in image configuration to form an electrostatic latent image on the imaging member, developing the electrostatic latent image with electrostatically attractable toner particles to form a toner image, transferring the toner image to a receiving member and repeating the depositing, exposing, developing and transferring steps. These imaging members may be fabricated by any of the various known methods.

In general, electrostatographic imaging members are well known in the art. An electrostatographic imaging member, including the electrostatographic imaging member of the present disclosure, may be prepared by any of the various suitable techniques, provided that an intermediate and/or undercoating layer is applied between the substrate and charge generating layer, as described herein. Suitable conventional photoreceptor designs that can be modified in accordance with the present disclosure include, but are not limited to, those described for example in U.S. Pat. Nos. 4,647,521, 4,664,995, 4,675,262, 4,678,731, 4,713,308, 4,717,637, 4,784,928, 4,869,982, 5,008,167, 5,096,795, and 5,707,767, the entire disclosures of which are incorporated herein by reference.

According to the present disclosure, the intermediate and/or undercoating layer includes hydrolyzed semi-conductive nanoparticles, such as hydrolyzed semi-conductive nanoparticles formed by reaction of a metal alkoxide and an amine, typically in a polymeric binder matrix. Typically, a flexible or rigid substrate is provided having an electrically conductive surface. The instant intermediate and/or undercoating layer is applied over the substrate, a charge generating layer is then usually applied to or over the intermediate and/or undercoating layer. An optional charge blocking layer may be applied to the electrically conductive surface or the intermediate and/or undercoating layer prior to the application of the charge generating layer. If desired, an adhesive layer may be utilized between any or all of the substrate, intermediate and/or undercoating layer, charge blocking layer, and the charge generating layer. A charge transport layer is then typically formed on the charge generation layer. However, in some embodiments, the charge transport layer may be applied prior to or together with the charge generation layer.

In the intermediate and/or undercoating layer of embodiments, any suitable metal alkoxide and amine can be used, to provide the hydrolyzed semi-conductive nanoparticles incorporated into the layer. However, in some embodiments, preferred hydrolyzed semi-conductive nanoparticles are formed by reaction of transition metal alkoxides and aliphatic amines.

Although not limited to any particular materials, the metal alkoxides of embodiments can include any suitable metal, including but not limited to transition metals such as zirconium, titanium, zinc, hafnium, vanadium, mixtures thereof, and the like. Specific examples of suitable metal alkoxides thus include, but are not limited to, zirconium isopropoxide, titanium (IV) isopropoxide, titanium (IV) methoxide, diisopropoxybisethylacetoacetato titanate, triethanolamine titanate, triethanolamine zirconate, titanium butoxide, titanium diisopropoxide bis(acetylacetonate), titanium diisopropoxide bis(2,2,6,6-tetramethyl-3,5-heptanedionate), titanium (IV) ethoxide, titanium (IV) 2-ethyl-1,3-hexanediolate, titanium (IV) 2-ethylhexoxide, zirconium (IV) tert-butoxide, zirconium (IV) acetylacetonate, zirconium (IV) acetate hydroxide, zirconium (IV) bis(diethyl citrate)dipropoxide, mixtures thereof, and the like.

Preferably, in embodiments, the metal alkoxide is titanium isopropoxide, particularly titanium (IV) isopropoxide.

The metal alkoxide is mixed with an amine to form the hydrolyzed semi-conductive nanoparticles. Suitable amines include, but are not limited to, 3-aminopropyltriethoxysilane, ethanolamine, 3-amino-1 , 2-propanediol, 3-aminopropyltrimethoxysilane, triethanolamine, polyoxyalkyleneamines (JEFFAMINES ® from Huntsman Company), N.N-dimethylaminoethyl methacrylate, mixtures thereof, and the like.

In forming the hydrolyzed semi-conductive nanoparticles, the metal alkoxide and amine are generally mixed together in a suitable reaction medium or solvent, and the hydrolysis reaction is allowed to proceed to completion. For example, a suitable reaction medium or solution can include an acid, preferably an inorganic acid, although organic acids can also be used. Examples of suitable inorganic acids that can be used include, but are not limited to, phosphoric acid, hydrochloric acid, nitric acid, sulfuric acid, mixtures thereof, and the like. Examples of suitable organic acids that can be used include, but are not limited to, acetic acid, formic acid, mixtures thereof, and the like. When used, the acid present in the mixture causes hydrolysis of trimethoxysilane groups or the like in the amine, to form the solid nanoparticles. Other methods for forming the hydrolyzed semi-conductive nanoparticles will be apparent to those skilled in the art based on this disclosure, and are encompassed thereby.

Once the hydrolyzed semi-conductive nanoparticles are formed, they can be optionally separated from the reaction mixture by known methods, such as filtering, washing, drying, and the like. Alternatively, depending on the particular reaction components used, the hydrolyzed semi-conductive nanoparticles may be directly used in subsequent processing steps without separation or purification.

The hydrolyzed semi-conductive nanoparticles are dispersed in a polymeric binder material to form the intermediate and/or undercoating layer. Typical suitable polymeric binders include, but are not limited to, polyvinylbutyral, poly (vinyl carbazole), organosilanes, nylon, epoxy resins, polyesters, polyamides, polyurethanes, polyvinylidene chloride resin, silicone resins, fluorocarbon resins, polycarbonates, polyacrylates and methacrylates, copolymers of vinyl chloride and vinyl acetate, phenoxy resins, phenolic resins, poly (vinyl alcohol), polyacrylonitrile, polystyrene, poly(vinylbenzyl alcohol), poly (2-hydroxyethyl methacrylate), poly(2-hydroxyethyl acrylate), poly(3-hydroxypropyl methacrylate), mixtures thereof, and the like.

In embodiments of the present disclosure, the hydrolyzed semi-conductive nanoparticles are preferably included in the intermediate and/or undercoating layer in an amount of from about 5 to about 95 percent by weight of the layer. Preferably, the hydrolyzed semi-conductive nanoparticles are included in an amount of from about 15 to about 85 percent, and more preferably from about 35 to about 75 percent, by weight of the intermediate and/or undercoating layer.

The particular construction of an exemplary imaging member will now be described in more detail. However, the following discussion is of only one embodiment, and is not limiting of the disclosure.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including, but not limited to, polyesters, polycarbonates, polyamides, polyurethanes, mixtures thereof, and the like. As electrically conductive materials there may be employed various resins that incorporate conductive particles, including, but not limited to, resins containing an effective amount of carbon black, or metals such as copper, aluminum, nickel, and the like. The substrate can be of either a single layer design, or a multilayer design including, for example, an electrically insulating layer having an electrically conductive layer applied thereon.

The electrically insulating or conductive substrate is preferably in the form of a rigid cylinder, drum or belt. In the case of the substrate being in the form of a belt, the belt can be seamed or seamless, with a seamless belt being particularly preferred.

The thickness of the substrate layer depends on numerous factors, including strength and rigidity desired and economical considerations. Thus, this layer may be of substantial thickness, for example, about 5000 micrometers or more, or of minimum thickness of less than or equal to about 150 micrometers, or anywhere in between, provided there are no adverse effects on the final electrostatographic device. The surface of the substrate layer is preferably cleaned prior to coating to promote greater adhesion of the deposited coating. Cleaning may be effected by any known process including, for example, by exposing the surface of the substrate layer to plasma discharge, ion bombardment and the like.

The conductive layer may vary in thickness over substantially wide ranges depending on the optical transparency and degree of flexibility desired for the electrostatographic member. Accordingly, for a photoresponsive imaging device having an electrically insulating, transparent cylinder, the thickness of the conductive layer may be between about 10 angstrom units to about 500 angstrom units, and more preferably from about 100 Angstrom units to about 200 angstrom units for an optimum combination of electrical conductivity and light transmission. The conductive layer may be an electrically conductive metal layer formed, for example, on the substrate by any suitable coating technique, such as a vacuum depositing technique. Typical metals include, but are not limited to, aluminum, zirconium, niobium, tantalum, vanadium and hafnium, titanium, nickel, stainless steel, chromium, tungsten, molybdenum, mixtures thereof, and the like. In general, a continuous metal film can be attained on a suitable substrate, e.g. a polyester web substrate such as MYLAR® available from E. I. du Pont de Nemours & Co., with magnetron sputtering.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. Regardless of the technique employed to form the metal layer, a thin layer of metal oxide generally forms on the outer surface of most metals upon exposure to air. Thus, when other layers overlying the metal layer are characterized as "contiguous" (or adjacent or adjoining) layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a conductive carbon black dispersed in a plastic binder as an opaque conductive layer. A typical electrical conductivity for conductive layers for electrophotographic imaging members in slow speed copiers is about $10^2$ to $10^3$ ohms/square.

After formation of an electrically conductive surface, the intermediate and/or undercoating layer (also known as a hole blocking layer) of the disclosure is formed. Generally, intermediate and/or undercoating layers for positively charged photoreceptors allow holes from the imaging surface of the photoreceptor to migrate toward the conductive layer. For negatively charged photoreceptors, the intermediate and/or undercoating layer allows electrons to migrate toward the conducting layer. According to the present disclosure, the intermediate and/or undercoating layer is doped with, or has uniformly or homogeneously mixed or dispersed therein, the above-described hydrolyzed semi-conductive nanoparticles.

The intermediate and/or undercoating layer can be further doped with fillers, such as metal oxides, to improve its functionality. However, in embodiments, it is preferred that the intermediate and/or undercoating layer not include any metal oxide particles, such as titanium dioxide, silicon oxide, or zirconium oxide, or that it be substantially free of such metal oxide particles.

The intermediate and/or undercoating layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the intermediate and/or undercoating layer is preferably applied in the form of a dilute solution, with the solvent being removed after deposition of the coating by conventional techniques such as by vacuum, heating and the like.

The intermediate and/or undercoating layer should be continuous, and can have any desirable thickness. Conventional intermediate and undercoating layers are believed by some to be limited to a thickness of about 5 μm. Beyond this thickness limitation, the exposed voltage, $V_{low}$, and cyclic stability properties deteriorate with the conventional art and make photoreceptors unsuitable for modern xerographic engines. However, various exemplary embodiments of this disclosure include an intermediate and/or undercoating layer having a thickness greater than 5 μm, which have been found not to possess such deteriorated exposed voltage and cyclic stability problems.

Accordingly, in embodiments, the intermediate and/or undercoating layer can be provided either as a thin layer, such as having a thickness of from about 1 μm or less to about 5 μm, such as from about 2 μm to about 5 μm. In other embodiments, however, a thick intermediate and/or undercoating layer can be provided, such as having a thickness of from about 7 μm to about 15 μm or about 20 μm, or from about 7 μm to about 30 μm or even about 40 μm or more, such as from about 8 μm to about 10 μm or about 15 μm. Of course, thicknesses within these ranges can also be used, and thus the intermediate and/or undercoating layer can be provided such as having a thickness of from about 1 μm or less to about 20 μm or more, such as from about 2 μm or about 3 μm to about 8 μm or about 10 μm. Thicknesses outside these ranges can also be used, as desired.

An optional adhesive layer may be applied to the intermediate and/or undercoating layer. Any suitable adhesive layer well known in the art may be utilized. Typical adhesive layer materials include, for example, but are not limited to, polyesters, DUPONT™ 49,000 (available from E. I. Dupont de Nemours and Company), VITEL™ PE100 (available from Goodyear Tire & Rubber), polyurethanes, and the like. Satisfactory results may be achieved with adhesive layer thickness between about 0.05 micrometer (500 angstrom) and about 0.3 micrometer (3,000 angstroms). Conventional techniques for applying an adhesive layer coating mixture to the intermediate and/or undercoating layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like. p Any suitable charge generating layer may be applied to the adhesive or intermediate and/or undercoating layer, which in turn can then be overcoated with a contiguous hole (charge) transport layer as described hereinafter. Examples of typical charge generating layers include, but are not limited to, inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from Dupont under the tradename Monastral Red, Monastral violet and Monastral Red Y, Vat orange 1 and Vat orange 3 trade names for dibromo anthanthrone pigments, benzimidazole perylene, perylene pigments as disclosed in U.S. Pat. No. 5,891,594, the entire disclosure of which is incorporated herein by reference, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-charge generating layer compositions may be utilized where a photoconductive layer enhances or reduces the properties of the charge generating layer. Examples of this type of configuration are described in U.S. Pat. No. 4,415,639, the entire disclosure of which is incorporated herein by reference. Other suitable charge generating materials known in the art may also be utilized, if desired.

Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and selenium tellurium alloys are also preferred because these materials provide the additional benefit of being sensitive to infra-red light.

Any suitable polymeric film forming binder material may be employed as the matrix in the charge generating binder layer. Typical polymeric film forming materials include, but are not limited to, those described, for example, in U.S. Pat. No. 3,121,006, the entire disclosure of which is incorporated herein by reference. Thus, typical organic polymeric film forming binders include, but are not limited to, thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly (amideimide), styrene-butadiene copolymers, vinylidenechloride-vinylchloride copolymers, vinylacetate-vinylidenechloride copolymers, styrene-alkyd resins, polyvinylcarbazole, mixtures thereof, and the like. These polymers may be block, random or alternating copolymers.

The charge generating composition or pigment may be present in the resinous binder composition in various amounts. Generally, however, the charge generating composition or pigment may be present in the resinous binder in an amount of from about 5 percent by volume to about 90 percent by volume of the charge generating pigment dispersed in about 10 percent by volume to about 95 percent by volume of the resinous binder, and preferably from about 20 percent by volume to about 30 percent by volume of the charge generating pigment is dispersed in about 70 percent by volume to about 80 percent by volume of the resinous binder composition. In one embodiment, about 8 percent by volume of the charge generating pigment is dispersed in about 92 percent by volume of the resinous binder composition.

The charge generating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The charge generating layer thickness is generally related to binder content. Thus, for example, higher binder content compositions generally require thicker layers for photogeneration. Thickness outside these ranges can be selected providing the objectives of the present disclosure are achieved.

Any suitable and conventional technique may be utilized to mix and thereafter apply the charge generating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

The electrophotographic imaging member of the present disclosure generally contains a charge transport layer in addition to the charge generating layer. The charge transport layer comprises any suitable organic polymer or non-polymeric material capable of transporting charge to selectively discharge the surface charge. Charge transporting layers may be formed by any conventional materials and methods, such as the materials and methods disclosed in U.S. Pat. No. 5,521,047 to Yuh et al., the entire disclosure of which is incorporated herein by reference. In addition, the charge transporting layers may be formed as an aromatic diamine dissolved or molecularly dispersed in an electrically inactive polystyrene film forming binder, such as disclosed in U.S. Pat. No. 5,709,974, the entire disclosure of which is incorporated herein by reference.

The charge transport layer of the disclosure generally include at least a binder and at least one arylamine charge transport material. The binder should eliminate or minimize crystallization of the charge transport material and should be soluble in a solvent selected for use with the composition such as, for example, methylene chloride, chlorobenzene, tetrahydrofuran, toluene or another suitable solvent. Suitable binders may include, for example, polycarbonates, polyesters, polyarylates, polyacrylates, polyethers, polysulfones and mixtures thereof. For the preferred solvent of methylene chloride and the preferred charge transport materials, the binder is preferably a polycarbonate. Although any polycarbonate binder may be used, preferably the polycarbonate is either a bisphenol Z polycarbonate or a biphenyl A polycarbonate. Example biphenyl A polycarbonates are the MAKROLON® polycarbonates. Example bisphenol Z polycarbonates are the LUPILON® polycarbonates, also widely identified in the art as PCZ polycarbonates, e.g., PCZ-800, PCZ-500 and PCZ-400 polycarbonate resins and mixtures thereof.

As the charge transport materials, at least one of the charge transport materials preferably comprise an arylamine compound, although others can be used. Arylamine charge transport materials can be subdivided into monoamines, diamines, triamines, etc. Examples of aryl monoamines include: bis-(4-methylphenyl)-4-biphenylylamine, bis(4-methoxyphenyl)-4-biphenylylamine, bis-(3-methylphenyl)-4-biphenylylamine, bis(3-methoxyphenyl)-4-biphenylylamine-N-phenyl-N-(4-biphenylyl)-p-toluidine, N-phenyl-N-(4-biphenylyl)-p-toluidine, N-phenyl-N-(4-biphenylyl)-m-anisidine, bis(3-phenyl)-4-biphenylylamine, N,N,N-tri[3-methylphenyl]amine, N,N,N-tri[4-methylphenyl]amine, N,N-di(3-methylphenyl)-p-toluidine, N,N-di(4-methylphenyl)-m-toluidine, bis-N,N-[(4'-methyl-4-(1,1'-biphenyl)]-aniline, bis-N,N-[(2'-methyl-4(1,1'-biphenyl)]-aniline, bis-N,N-[(2'-methyl-4(1,1'-biphenyl)]-p-toluidine, bis-N,N-[(2'-methyl-4(1,1'-biphenyl)]-m-toluidine, and N,N-di-(3,4-dimethylphenyl)-4-biphenylamine (DBA), and mixtures thereof. Examples of aryl diamines include: those described in U.S. Pat. Nos. 4,306,008, 4,304,829, 4,233,384, 4,115,116, 4,299,897, 4,265,990, 4,081,274 and 6,214,514, each incorporated herein by reference. Typical aryl diamine transport compounds include N,N'-diphenyl-N,N'-bis(alkylphenyl)-[1,1'-biphenyl]-4,4'-diamine wherein the alkyl is linear such as for example, methyl, ethyl, propyl, n-butyl and the like, N,N'-diphenyl-N,N'-bis(3-methylphenyl)-[1,1'-biphenyl]-4,4'-diamine, N,N'-diphenyl-N,N'-bis(3-hydroxyphenyl)-(1,1'-biphenyl)-4,4'-diamine, N,N'-diphenyl-N,N'-bis(4-methylphenyl)-[1,1'-biphenyl]-4,4'-diamine, N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, mixtures thereof and the like.

Typically, the charge transport material is present in the charge transport layer in an amount of from about 5 to about 80 percent by weight, and preferably from about 25 to about 75 percent by weight, and the binder is present in an amount of from about 20 to about 95 percent by weight, and preferably from about 25 to about 75 percent by weight, although the relative amounts can be outside these ranges. Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra-red radiation drying, air drying and the like.

Generally, the thickness of the charge transport layer is between about 10 and about 50 micrometers, but thicknesses outside this range can also be used. The charge transport layer should preferably be an insulator to the extent that the electrostatic charge placed on the charge transport layer is not conducted in the absence of illumination at a rate sufficient to prevent formation and retention of an electrostatic latent image thereon. In general, the ratio of thickness of the charge transport layer to the charge generator layer is preferably maintained from about 2:1 to 200:1 and in some instances as great as 400:1. In other words, the charge transport layer is substantially non-absorbing to visible light or radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

An overcoat layer, preferably a continuous overcoat layer, may optionally be applied over the charge transport layer, if desired.

The thickness of the continuous overcoat layer selected may depend upon the abrasiveness of the charging (e.g., bias charging roll), cleaning (e.g., blade or web), development (e.g., brush), transfer (e.g., bias transfer roll), etc., system employed and can range up to about 10 micrometers. A thickness of between about 1 micrometer and about 5 micrometers in thickness is preferred, in embodiments. However, depending upon specific overcoating layer materials, thicker overcoating layers can be employed in other embodiments. In these embodiments, the thickness can be between about 0.01 micrometer and about 20 micrometers in thickness.

Any suitable and conventional technique may be utilized to mix and thereafter apply the overcoat layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. The dried overcoating of this disclosure should transport holes during imaging and should not have too high a free carrier concentration. Free carrier concentration in the overcoat increases the dark decay. Preferably the dark decay of the overcoated layer should be the same as that of the unovercoated device.

Other layers may also be used, such as a conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

In some cases, an anti-curl back coating may be applied to the side opposite the photoreceptor to provide flatness and/or abrasion resistance. These anti-curl back coating layers are well known in the art and may comprise thermoplastic organic polymers or inorganic polymers that are electrically insulating or slightly semiconductive.

Any suitable conventional electrophotographic charging, exposure, development, transfer, fixing and cleaning techniques may be utilize to form and develop electrostatic latent images on the imaging member of this disclosure. Thus, for example, conventional light lens or laser exposure systems may be used to form the electrostatic latent image. The resulting electrostatic latent image may be developed by suitable conventional development techniques such as magnetic brush, cascade, powder cloud, and the like.

While the disclosure has been described in conjunction with the specific embodiments described above, it is evident that many alternatives, modifications and variations are apparent to those skilled in the art. Accordingly, the preferred embodiments of the disclosure as set forth above are intended to be illustrative and not limiting. Various changes can be made without departing from the spirit and scope of the disclosure.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Example 1

Preparation of Hydrolyzed Semi-Conductive Nanoparticles

A mixture is made of titanium (IV) isopropoxide (98+% purity), 3-aminoproyltrimethoxysilane (97% purity), and 3% by weight phosphoric acid aqueous solution, all available from Fisher Scientific, Inc. The solution is made by adding 10.0 grams titanium (IV) isopropoxide and 10.0 grams 3-aminoproyltrimethoxysilane into 100 mL 3% by weight phosphoric acid aqueous solution, with stirring. Stirring is continued overnight allowing the reaction to proceed. The resultant product is filtered, washed with 200 mL water, and dried for 24 hours in a 120° C. over. The final product obtained is 9.7 grams hydrolyzed semi-conductive nanoparticles, which are yellowish in color. The resultant solution is ready for formulating into a coating solution for an imaging member.

Example 2

Preparation of Coating Solution

A coating solution is prepared using the hydrolyzed semi-conductive nanoparticles of Example 1. The solution is made by forming a solution of 7.0 grams hydrolyzed semi-conductive nanoparticles of Example 1, 14.0 grams Varcum phenolic resin (available from Durez Corporation), and 20 grams n-butanol. The mixture is mixed with 40 grams of $ZrO_2$ beads in a brown glass bottle. The mixture is roll-milled for one week. Following mixing, the beads are removed, providing a solution that is ready for coating an imaging member.

Example 3

Preparation of a Drum Coated Photoreceptor

An electrophotographic imaging member is prepared. The imaging member includes a 30 mm diameter honed aluminum substrate, an undercoating layer, a charge generating layer, and a charge transport layer. The intermediate and/or undercoating layer is coated on the aluminum substrate using the coating solution of Example 2. The intermediate and/or undercoating layer is applied at a thickness of 9.6 micrometer, and is dried at 160° C. for 15 minutes. The charge generating layer is coated using a solution of 9.6 parts by weight chlorogallium phthalocyanine (ClGaPC) in 14.4 parts by weight VMCH (available from Union Carbide) in 76 parts by weight of solvent mixture, consisting of 50:50 by weight butyl alcohol:xylene. The charge generating layer is air dried at room temperature. The dried charge generator layer thickness is about 0.2 micrometer.

A charge transporting layer is coated using a solution of a mixture of 60 weight % of PCZ-400 (a polycarbonate), and 40 weight % of charge transport molecule (N,N'-diphenyl-N,N'-bis(3-methylpropyl)-(1,1'-biphenyl)-4,4'-diamine). The solution is in 70:30 by weight ratio of tetrahydrofuran:toluene solvent mixture, providing an approximate solids content of 33% by weight. The charge transporting layer is dried at 135° C. for 45 minutes. The dried charge transporting layer thickness is about 25 microns.

For comparison, a reference imaging device is prepared in the same manner described above, except that the intermediate and/or undercoating layer is changed. In the comparison example, the intermediate and/or undercoating layer is a blocking layer formed by coating using a solution of Luckamide (a polyamide film forming polymer available from Dai Nippon Ink) in a mixture of methanol, butanol and water, at 55, 36 and 9 parts by weight. The blocking layer is applied at a thickness of 1.0 micrometer, and is dried at 145° C. for 15 minutes.

Example 4

Electrical Test of the Photoreceptor

The electrical properties of the prepared photoreceptor device with the present undercoat layer are tested in accordance with standard drum photoreceptor test methods. The electrical properties of the photoreceptor sample prepared according to Example 3 is evaluated with a xerographic testing scanner. The drums are rotated at a constant surface speed of 15.7 cm per second. A direct current wire scorotron, narrow wavelength band exposure light, erase light, and four electrometer probes were mounted around the periphery of the mounted photoreceptor samples. The sample charging time is 177 milliseconds. The exposure light has an output wavelength of 680 nanometers (nm) and the erase light has an output wavelength of 550 nm.

The test sample is first rested in the dark for at least 60 minutes to ensure achievement of equilibrium with the testing conditions at 50 percent relative humidity and 72° F. The sample is then negatively charged in the dark to a potential of about 500 volts. The test procedure is repeated to determine the photo induced discharge characteristic (PIDC) of the sample by different light energies of up to 40 ergs/cm$^2$.

The resultant obtained PIDC characteristic curve illustrates a very good photo-induced discharge performance. Other electrical properties are shown in Table 1.

TABLE 1

| V(0) (volt) | V(2.6) (volt) | V(4.26) (volt) | V(13) (volt) | Dv/dx (volt*cm$^2$/erg.) |
|---|---|---|---|---|
| 581 | 174 | 107 | 79 | −164 |

With reference to the abbreviations employed in Table 1:
V(0) (PIDC) = the dark voltage after scorotron charging
V(2.6) = average voltage after exposure to 2.6 erg/cm$^2$
V(4.26) = average voltage after exposure to 4.26 erg/cm$^2$
V(13) = average voltage after exposure to 13 erg/cm$^2$
dV/dX = the initial slope of the PIDC

TABLE 2

| Vr (volt) | Vr 100K (volt) | Verase (volt) | Dark decay (volt) | Q/A PIDC (nC/cm&thsp;2) |
|---|---|---|---|---|
| 68 | 72 | 62 | 24 | 64 |

With reference to the abbreviations employed in Table 2
Vr = initial residual voltage
Vr[100K] = residual voltage after 100,000 electrical cycles
Q/A PIDC = the current density to charge the devices to the V(0) values
Dark Decay = 0.2 s Duration Decay voltage
Verase = average voltage after erase exposure This example exhibits excellent charging characteristics with low residual potential and low dark decay.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An electrophotographic imaging member, comprising:
a substrate having an electrically conductive surface;
an intermediate layer; and
a photoconductor layer;
wherein the intermediate layer comprises hydrolyzed semi-conductive nanoparticles, wherein the hydrolyzed semi-conductive nanoparticles are formed by reaction of a metal alkoxide and an amine; and
wherein the amine is selected from the group consisting of ethanolamine, 3-amino-1,2-propanediol, triethanolamine, polyoxyalkyleneamines, N,N-dimethylaminoethyl methacrylate, and mixtures thereof.

2. The electrophotographic imaging member according to claim 1, wherein the intermediate layer further comprises a polymer resin.

3. The electrophotographic imaging member according to claim 1, wherein the metal alkoxide is a transition metal alkoxide.

4. The electrophotographic imaging member according to claim 1, wherein the metal alkoxide is selected from the group consisting of zirconium alkoxides, titanium alkoxides, zinc alkoxides, hafnium alkoxides, vanadium alkoxides, and mixtures thereof.

5. The electrophotographic imaging member according to claim 1, wherein the metal alkoxide is selected from the group consisting of zirconium isopropoxide, titanium (IV) isopropoxide, titanium (IV) methoxide, diisopropoxybisethylacetoacetato titanate, triethanolamine titanate, triethanolamine zirconate, titanium butoxide, titanium diisopropoxide bis (acetylacetonate), titanium diisopropoxide bis(2,2,6,6-tetramethyl-3,5-heptanedionate), titanium (IV) ethoxide, titanium (IV) 2-ethyl- 1,3-hexanediolate, titanium (IV) 2-ethyihexoxide, zirconium (IV) tert-butoxide, zirconium (IV) acetylacetonate, zirconium (IV) acetate hydroxide, zirconium (IV) bis(diethyl citrate)dipropoxide, and mixtures thereof.

6. The electrophotographic imaging member according to claim 1, wherein the metal alkoxide is titanium (IV) isopropoxide.

7. The electrophotographic imaging member according to claim 1, wherein the hydrolyzed semi-conductive nanoparticles are formed by reaction of the metal alkoxide and the amine in the presence of an acid.

8. The electrophotographic imaging member according to claim 7, wherein the acid is selected from the group consisting of inorganic acids and organic acids.

9. The electrophotographic imaging member according to claim 7, wherein the acid is selected from the group consisting of phosphoric acid, hydrochloric acid, nitric acid, sulfuric acid, acetic acid, formic acid, and mixtures thereof.

10. The electrophotographic imaging member according to claim 2, wherein the polymer resin is selected from the group consisting of polyvinylbutyral, poly(vinyl carbazole), organosilanes, nylon, epoxy resins, polyesters, polyamides, polyurethanes, polyvinylidene chloride resin, silicone resins, fluorocarbon resins, polycarbonates, polyacrylates and methacrylates, copolymers of vinyl chloride and vinyl acetate, phenoxy resins, phenolic resins, poly(vinyl alcohol), polyacrylonitrile, polystyrene, poly(vinylbenzyl alcohol), poly(2-hydroxyethyl methacrylate), poly(2-hydroxyethyl acrylate), poly(3-hydroxypropyl methacrylate), and mixtures thereof.

11. The electrophotographic imaging member according to claim 1, wherein the intermediate layer is from about 1 μ to 20 μ in thickness.

12. The electrophotographic imaging member according to claim 1, wherein the intermediate layer from about 7 μ to 20 μ in thickness.

13. The electrophotographic imaging member according to claim 1, wherein the intermediate layer is substantially free of metal oxide particles other than the hydrolyzed semi-conductive nanoparticles.

14. A process for forming an imaging member, comprising:

providing an imaging member substrate having an electrically conductive surface, and applying an intermediate layer over said substrate, and applying at least a charge generating layer and a charge transport layer over said intermediate layer, and wherein said intermediate layer comprises hydrolyzed semi-conductive nanoparticles, wherein the hydrolyzed semi-conductive nanoparticles are formed by reaction of a metal alkoxide and an amine; and wherein the amine is selected from the group consisting of ethanolamine, 3-amino-1,2-propanediol, triethanolamine, polyoxyalkyleneamines, N,N-dimethylaminoethyl methacrylate, and mixtures thereof.

15. The process according to claim 14, wherein the hydrolyzed semi-conductive nanoparticles are formed by reaction of the metal alkoxide and the amine in the presence of an inorganic acid.

* * * * *